United States Patent [19]

Winston

[11] 3,964,058

[45] June 15, 1976

[54] DO NOT DISTURB DOORBELL

[76] Inventor: Billy G. Winston, 1900 E. 4th St., Fort Worth, Tex. 76104

[22] Filed: May 28, 1974

[21] Appl. No.: 473,561

[52] U.S. Cl. ..... 340/330; 340/326

[51] Int. Cl.[2] ..... G08B 3/00

[58] Field of Search ..... 340/330, 286, 332, 326, 340/327, 328, 324 R, 272

[56] References Cited

UNITED STATES PATENTS

| | | | |
|---|---|---|---|
| 1,606,404 | 11/1926 | Eastman | 340/326 |
| 3,017,623 | 1/1962 | Bishofberger | 340/326 |

*Primary Examiner*—John W. Caldwell
*Assistant Examiner*—Donnie L. Crosland
*Attorney, Agent, or Firm*—Wofford, Felsman, Fails & Zobal

[57] ABSTRACT

A doorbell system for a residence comprising a first push button switch for actuating a bell when the resident is expecting callers. When the resident is not expecting callers, a light illuminates a message to inform the caller that the resident does not wish to be disturbed unless there is an emergency. In this event, the caller is to push a second push button switch located near the message for actuating the bell. A control switch controls actuation of the two push button switches and the light.

2 Claims, 2 Drawing Figures

DO NOT DISTURB DOORBELL

BACKGROUND OF THE INVENTION

This invention relates to a doorbell system for allowing the resident to inform callers that he or she is busy and does not wish to be disturbed except in the event of an emergency.

Most residences employ an electrically actuated bell in the residence and a push button switch located outside the residence for use by a caller to announce his arrival or to determine whether the resident is at home. In many instances, however, the resident may be busy or asleep and does not wish to be disturbed by callers unless there is an emergency. This is not possible however, with the conventional doorbell system since it employs a single push button switch with no means for informing the caller that the resident does not wish to be disturbed unless there is an emergency.

SUMMARY OF THE INVENTION

It is an object of the present invention to provide a doorbell system which allows the resident to inform a caller that he does not wish to be disturbed unless there is an emergency. The doorbell system employs a bell and push button switch conventionally used in residences and in addition, a second push button switch and an electrical light for illuminating a message held by a message holding device. Also provided is a control switch which may be moved to a first position to allow the first push button switch to actuate the bell or to a second position to energize the light and allow the second push button switch to actuate the bell.

In a further aspect, the system comprises a source of electrical power, an electrically actuated bell to be located in the residence and coupled to the source of electrical power; switch means coupled to the source of power and movable to first and second positions; and a first push button switch to be located on the outside of the residence at a convenient location. The first push button switch is electrically coupled to the switch means and to the source of power by way of the bell for energizing the bell when pushed and when the switch means is moved to its first position. In addition, there is provided a message holding means to be located on the outside of the residence for holding a message. An electrical light is located on the outside of the residence for illuminating the message. The light is coupled to the source of power and is adapted to be energized when the switch means is moved to its second position. A second push button switch is located on the outside of the residence at a position spaced from the first push button switch. This second push button switch is coupled to the switch means and to the source of power by way of the bell for energizing the bell when pushed and when the switch means is moved to its second position.

DETAILED DESCRIPTION OF THE INVENTION

Figure 1:
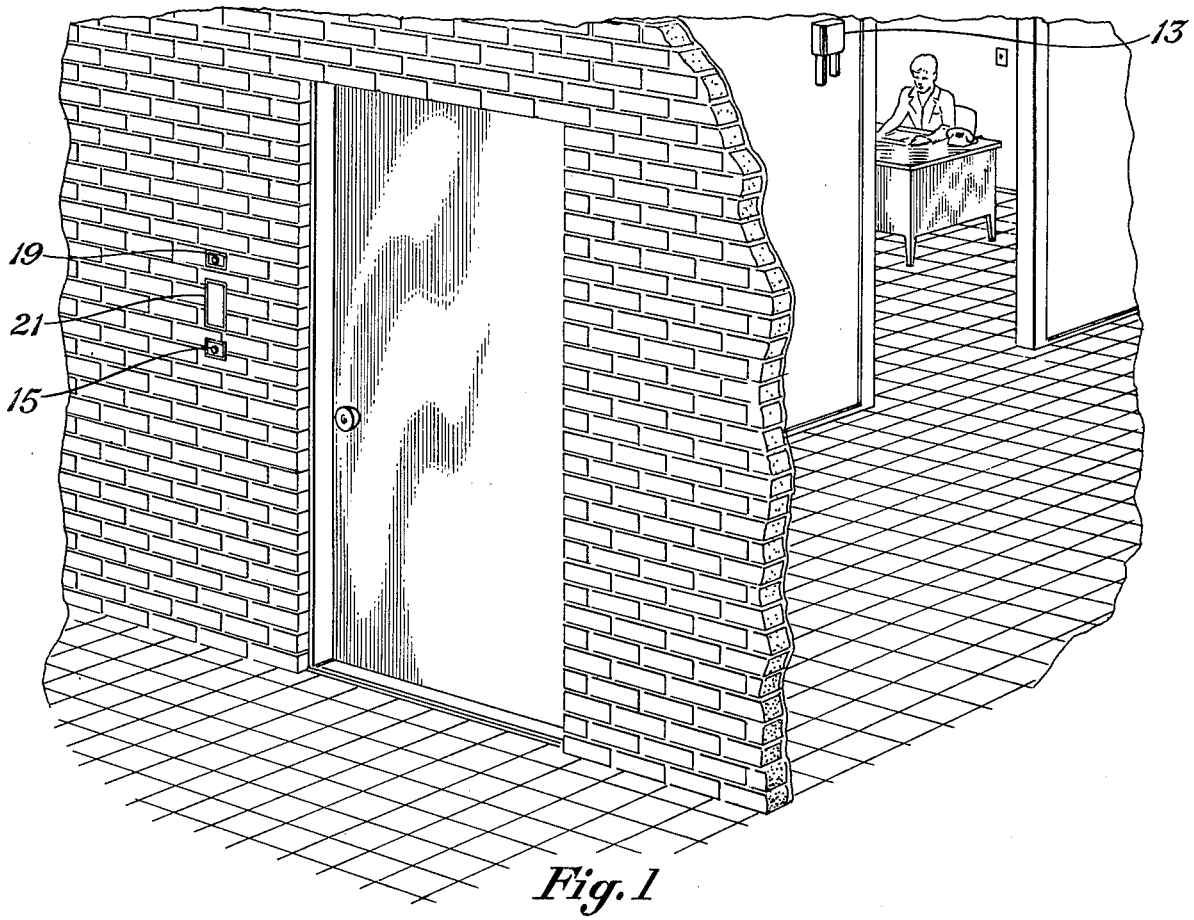
FIG. 1 illustrates a cutaway portion of a home illustrating an interior bell, two exterior push button switches, and a message holding device located on the outside wall next to the door of a residence.
Figure 2:
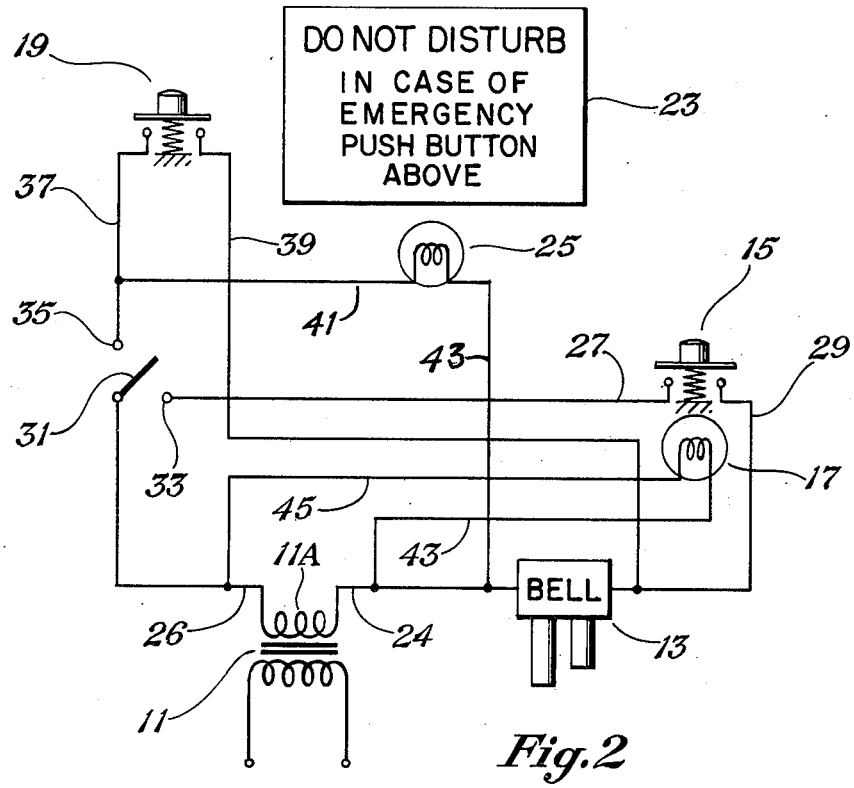
FIG. 2 is a schematic diagram of the doorbell system of the present invention.

Referring now to the drawings, the system shown incorporates the conventional doorbell system which comprises a step-down transformer 11, an electrically actuated bell 13 and a push button switch 15 for actuating the bell by pushing the switch 15 inward. In the conventional doorbell system, one terminal of the push button switch 15 is connected directly to one side of the secondary 11A of the transformer 11 while the other terminal is coupled to the other side of the secondary of the transformer by way of the bell 13 whereby when the switch 15 is pushed inward, current flows through the electrical actuating system of the bell 13 to cause it to ring. Also connected across the secondary 11A of the transformer 11 is an electrical light 17 for continuously illuminating the switch 15 which may be a translucent member with the light 17 located behind the translucent member.

In accordance with the present invention, there is also provided a second push button switch 19, a holding device or frame 21 for holding a medium 23 on which is written or printed a message, and an electrical light 25 for illuminating the message. The medium 23 may be a translucent sheet with the light 25 located behind the sheet. In addition, there is provided a control switch 31 which may be moved to contact a first terminal 33 or a second terminal 35. When in contact with the first terminal 33, the switch 15 is allowed to actuate the bell 13, when pushed. When the switch 31 contacts the second terminal 35, the light 25 will be energized to illuminate the medium 23 to clearly display its message and in addition, the push button switch 19 is allowed to actuate the bell 13, when pushed.

As illustrated in FIG. 1, the push button switch 15 is located at the usual height and is the first switch the caller generally will see. The frame 21 and its message 23 is located above the switch 15 and located above the frame 21 is the second push button switch 19. The control switch 31 will be located in a convenient position inside the residence. In the usual mode of operation, when the resident is at home and is accepting callers, the switch 31 will be moved to contact terminal 33 thereby allowing switch 15 to actuate the bell 13, when pushed. Since switch 31 is in contact with terminal 33, the light 25 will be de-energized and the push button switch 19 will be incapable of actuating the bell, if pushed. If the resident is at home and does not wish to be disturbed except in the case of an emergency, he will move the control switch 31 to contact terminal 35. In this position, the switch 15 cannot actuate the bell. The light 25 will be energized to illuminate the medium 23 to clearly display its message and in addition, the switch 19 will be rendered capable of actuating the bell, if pushed. Normally the caller will first see the push button switch 15 and push the switch. If he hears no bell, then he will look up and see the medium 23 illuminated by the light 25. Upon reading the message carried by the medium 23, the caller will know that the resident does not wish to be disturbed except in the case of an emergency. In this case, the message tells the caller to push the bell 19 to call or inform the resident.

In a more detailed description of the system, it can be seen that first and second electrical leads 24 and 26 are coupled across the secondary 11A of the transformer 11. A first pair of electrical leads 27 and 29 are coupled to opposite terminals of the first push button switch 15. A second pair of electrical leads 37 and 39 are coupled to opposite terminals of the second push button switch 19. Lead 27 is coupled to terminal 33 while lead 37 is coupled to terminal 35. The switch 31 is connected to lead 26 and is adapted to be connected to either lead 27 or 37 by moving it in contact with terminals 33 or 35 respectively. The bell 13 has one side connected to both leads 29 and 39 of the push button switches 15 and 19 and its other side connected to lead 24. A third pair of electrical leads 41 and 43 are connected to opposite terminals of the electrical light 25 with lead 41 being connected to lead 37 and lead 43 being connected to lead 24. Electrical light 17 is connected across the secondary 11A of the transformer 11 by way of leads 45 and 47.

Although the above system was described as being employed in a residence, it is to be understood that it may be employed in a business.

I claim:

1. A doorbell system for a business or residence comprising:

an electrical transformer, an electrically actuated bell located in said business or residence and coupled to said electrical transformer, switch means coupled to said electrical transformer and movable to first and second positions, a first push button switch located on the outside of the business or residence at a convenient location, said first push button switch being electrically coupled to said switch means and to said electrical transformer by way of said bell for energizing said bell when pushed and when said switch means is moved to said first position, message holding means located on the outside of the business or residence for holding a message, an electrical light located on the outside of the business or residence for illuminating the message held by said message holding means, circuit means coupling said electrical light to said electrical transformer to allow said electrical light to be energized when said switch means is moved to said second position, a second push button switch located on the outside of the business or residence at a position spaced from said first push button switch, said second push button switch being coupled to said switch means and to said electrical transformer by way of said bell for energizing said bell when pushed and when said switch means is moved to said second position.

2. A doorbell system for a residence comprising:

an electrical transformer having a secondary winding, a first push button switch located on the outside wall of a residence at a convenient location, a second push button switch located on the outside wall of a residence at a position spaced from said first push button switch, message holding means located on the outside wall of the residence for holding a message, an electrical light located on the outside wall of the residence for illuminating the message held by said message holding means, an electrically actuated bell located in said residence, first and second electrical leads connected to opposite terminals of said secondary winding of said electrical transformer, a first pair of electrical leads connected to opposite terminals of said first push button switch, a second pair of electrical leads connected to opposite terminals of said second push button switch, a movable control switch means located in said residence and supported to separately connect said second electrical lead with one electrical lead of said first pair and with one electrical lead of said second pair, said bell having one side connected to the other electrical leads of said first and second pairs and its other side connected to said first electrical lead, and a third pair of electrical leads connected to opposite terminals of said electrical light, one of said leads of said third pair being connected to said one electrical lead of said second pair and the other of said leads of said third pair being connected to said first electrical lead.

* * * * *